US009516934B2

(12) United States Patent
Frost et al.

(10) Patent No.: US 9,516,934 B2
(45) Date of Patent: Dec. 13, 2016

(54) UMBRELLA, AND A TIP ELEMENT FOR AN UMBRELLA FRAME

(76) Inventors: Hubert Samuel Frost, Etobicoke (CA); Paul W. Dorsett, Milton (CA)

( * ) Notice: Subject to any disclaimer, the term of this patent is extended or adjusted under 35 U.S.C. 154(b) by 0 days.

(21) Appl. No.: 13/498,011

(22) PCT Filed: Sep. 27, 2010

(86) PCT No.: PCT/CA2010/001532

§ 371 (c)(1),
(2), (4) Date: Mar. 23, 2012

(87) PCT Pub. No.: WO2011/035441

PCT Pub. Date: Mar. 31, 2011

(65) Prior Publication Data

US 2012/0180835 A1 Jul. 19, 2012

Related U.S. Application Data

(60) Provisional application No. 61/245,880, filed on Sep. 25, 2009.

(51) Int. Cl.

| | |
|---|---|
| ***A45B 25/18*** | (2006.01) |
| *A45B 19/10* | (2006.01) |
| *A45B 11/00* | (2006.01) |

(52) U.S. Cl.

CPC ..... *A45B 25/18* (2013.01); *A45B 19/10* (2013.01); *A45B 2011/005* (2013.01)

(58) Field of Classification Search

CPC ..... A45B 25/02; A45B 25/04; A45B 25/22; A45B 25/18; A45B 11/00; A45B 9/04; E04H 15/28; E04H 15/42; E04H 12/2238

USPC ..... 135/31–32, 33.2–33.5, 20.1, 25.317, 44; 16/319–321, 333–334

See application file for complete search history.

(56) References Cited

U.S. PATENT DOCUMENTS

| | | | | | |
|---|---|---|---|---|---|
| 664,123 | A | * | 12/1900 | Carmelich | 135/33.4 |
| 2,017,753 | A | * | 10/1935 | Goldman | A45B 25/18 135/33.5 |
| 2,072,254 | A | | 3/1937 | Evans | |
| 2,185,587 | A | * | 1/1940 | Carlisle | 135/33.5 |
| 2,531,735 | A | | 11/1950 | Jones | |
| 2,625,947 | A | * | 1/1953 | Ferrante | 135/33.5 |
| 2,753,878 | A | | 7/1956 | Halberstam | |
| 2,816,560 | A | | 12/1957 | Wuster | |
| 3,042,055 | A | | 7/1962 | Todorovic | |
| 3,954,117 | A | | 5/1976 | Wallace | |
| 4,607,653 | A | * | 8/1986 | Hermanson | 135/20.3 |
| 5,101,844 | A | * | 4/1992 | Morrone | 135/33.5 |
| 5,305,771 | A | | 4/1994 | Wilk | |

(Continued)

FOREIGN PATENT DOCUMENTS

| | | | |
|---|---|---|---|
| CN | 2161127 | Y | 4/1994 |
| CN | 2901973 | Y | 5/2007 |

(Continued)

*Primary Examiner* — Winnie Yip

(57) ABSTRACT

A tip element, for mounting on to a rib of an umbrella frame, comprises a pair of wings, and optionally a mounting portion for mounting onto the umbrella rib. The wings at least defining an outer edge for a canopy mounted on the umbrella frame, wherein one wing may be mounted for pivotal movement relative to the umbrella rib. The wings, or at least one of the wings, can be pivotally mounted to the mounting portion by living or other hinges. Alternatively, the wings can be pivot directly about the umbrella rib.

21 Claims, 21 Drawing Sheets

(56) References Cited

U.S. PATENT DOCUMENTS

| | | | | | |
|---|---|---|---|---|---|
| 5,394,896 | A | | 3/1995 | Wilk | |
| 5,487,401 | A | * | 1/1996 | Johnson et al. | 135/33.7 |
| 5,564,450 | A | * | 10/1996 | Sokoloski | 135/33.5 |
| 5,595,202 | A | * | 1/1997 | Scaccia | 135/33.6 |
| 5,694,958 | A | * | 12/1997 | Chang | 135/33.5 |
| 5,842,493 | A | | 12/1998 | Yakubisin | |
| 5,894,855 | A | | 4/1999 | Gefell | |
| 6,053,188 | A | | 4/2000 | Walker | |
| 6,302,125 | B1 | | 10/2001 | Lin | |
| 6,318,390 | B1 | | 11/2001 | Innis | |
| D466,281 | S | | 12/2002 | Pontiff | |
| 7,197,791 | B1 | * | 4/2007 | Smith | 16/375 |
| 7,913,709 | B2 | * | 3/2011 | Brebner | 135/33.5 |
| D646,886 | S | * | 10/2011 | Quinn | D3/10 |
| D652,203 | S | * | 1/2012 | Blauer | D3/5 |
| 8,893,736 | B2 | * | 11/2014 | Kazim | A45B 19/04 135/20.3 |
| 2007/0272288 | A1 | * | 11/2007 | Brebner | 135/33.5 |
| 2008/0000510 | A1 | | 1/2008 | Lin et al. | |
| 2010/0307548 | A1 | * | 12/2010 | Cain et al. | 135/20.1 |

FOREIGN PATENT DOCUMENTS

| | | | |
|---|---|---|---|
| CN | 201260448 | Y | 6/2009 |
| CN | 201328444 | Y | 10/2009 |
| DE | 20215089 | U1 | 1/2003 |
| EP | 0252192 | A1 | 1/1988 |
| EP | 0723407 | BI | 8/2000 |
| GB | 2344286 | A | 6/2000 |
| JP | 54097147 | | 8/1979 |
| JP | 58022003 | Y2 | 5/1983 |
| JP | 9065916 | | 3/1997 |
| JP | 3069419 | B2 | 7/2000 |
| NL | 6810620 | A | 1/1969 |
| NZ | 508285 | A | 11/2002 |
| WO | 0076356 | A1 | 12/2000 |
| WO | 2005048765 | A1 | 6/2005 |
| WO | 2006132525 | A2 | 12/2006 |

* cited by examiner

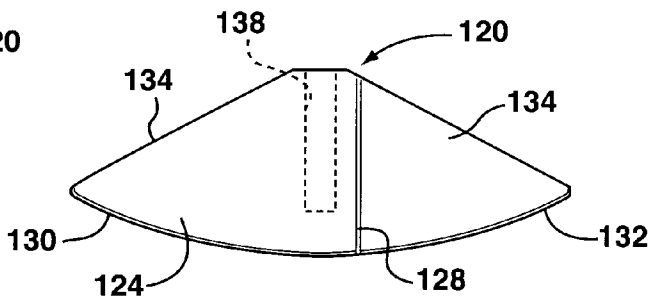
FIG. 14
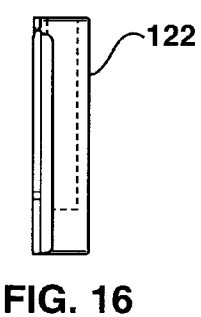
FIG. 16
FIG. 15
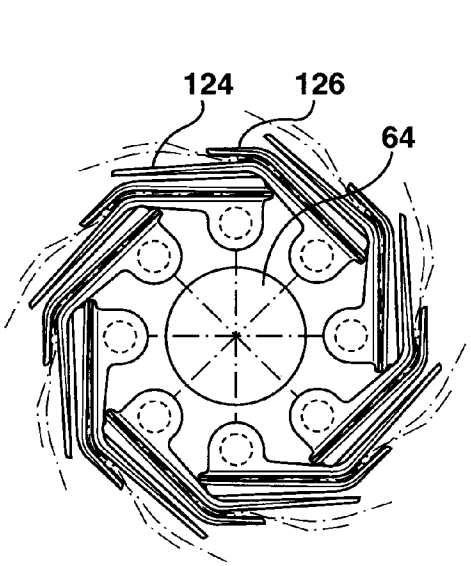
FIG. 21
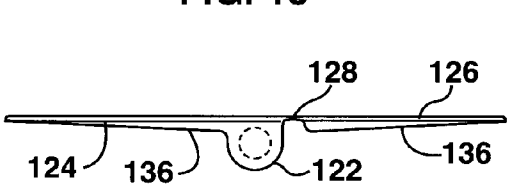
FIG. 18
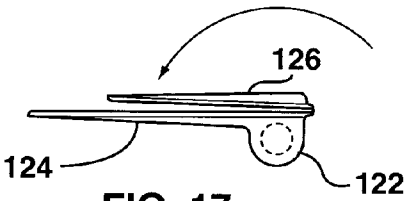
FIG. 17
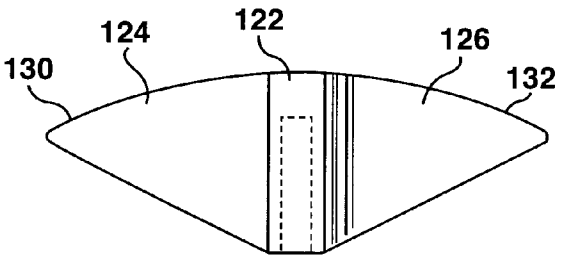
FIG. 20
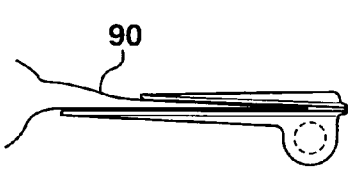
FIG. 19

UMBRELLA, AND A TIP ELEMENT FOR AN UMBRELLA FRAME

FIELD

This invention relates to umbrellas and to tip elements for use on the umbrella frame.

BACKGROUND

The following paragraphs are not an admission that anything discussed in them is prior art or part of the knowledge of persons skilled in the art.

There are known a number of umbrella designs. These are used to protect a user from rain, sun and and/or wind. A conventional umbrella has a rigid central shaft and a plurality of ribs or spokes attached to the top of the central shaft. Supporting struts or connecting ribs connect the ribs or spokes to a slider on the central shaft. The frame of the umbrella is thus movable between open and closed configurations, but each rib or spoke is of fixed dimensions, and is usually of one piece construction.

Other umbrella designs are described as compact or multiple fold, and sometimes as collapsible. They have ribs that have a two or more rib elements pivotally connected together, and usually the central shaft has two or more elements that telescope together, so that when collapsed or folded, the umbrella is smaller and more compact.

For all these known umbrella designs, the ends of the ribs are generally perpendicular to the periphery of the canopy and are exposed. Even if the ribs are rounded or otherwise provided with protective elements, they still can be a nuisance to others and a danger to people's eyes.

U.S. Pat. Nos. 5,394,896 and 5,305,771 to Peter Wilk discloses a frame for an umbrella that has ends of the ribs connected together by curved elements, intended to eliminate the problem of the tips of the ribs protruding beyond the canopy. However, this patent fails to recognize that in a collapsed or folded configuration, the effective radius of the ribs is increased beyond the effective radius in the open configuration. This proposal does not have the edge or periphery of the canopy attached to the frame at any point.

A more recent proposal is disclosed in published PCT application WO 2005/048765 (Brebner). It provides a complex arrangement, in which the ribs have rods sliding within tubes, to actuate force spreading components at the ends of the ribs.

An example of an asymmetric umbrella is disclosed in published PCT application WO2006/132525 (Senz Technologies B.V.). The entire content of all the patents and published applications disclosed herein are hereby incorporated by reference.

INTRODUCTION

The following introduction is intended to introduce the reader to this specification but not to define any invention. One or more inventions may reside in a combination or sub-combination of the apparatus elements or method steps described below or in other parts of this document. The inventors do not waive or disclaim his rights to any invention or inventions disclosed in this specification merely by not describing such other invention or inventions in the claims.

BRIEF DESCRIPTION OF THE DRAWINGS

For a better understanding of the present invention and to show more clearly how it may be carried into effect, reference will now be made, by way of example, to the accompanying drawings which show, by way of example, the present invention and in which:

FIG. 14 is a perspective view of a second embodiment of the tip element;

FIG. 15 is a top view of the second embodiment of the tip element;

FIG. 16 is a side view of the second embodiment of the tip element;

FIG. 17 is a end view of the second embodiment of the tip element, showing pivoting of one wing, to a folded position;

FIG. 18 is an end view of the second embodiment of the tip element in an extended position;

FIG. 19 is an end view of the second embodiment of the tip element, similar to FIG. 17, showing portions of canopy fabric;

FIG. 20 is a view from underneath of the second embodiment of the tip element;

FIG. 21 is an axial view, in partial section of an umbrella including tip elements of the second embodiment, shown in a closed position;

DETAILED DESCRIPTION

Figure 1:
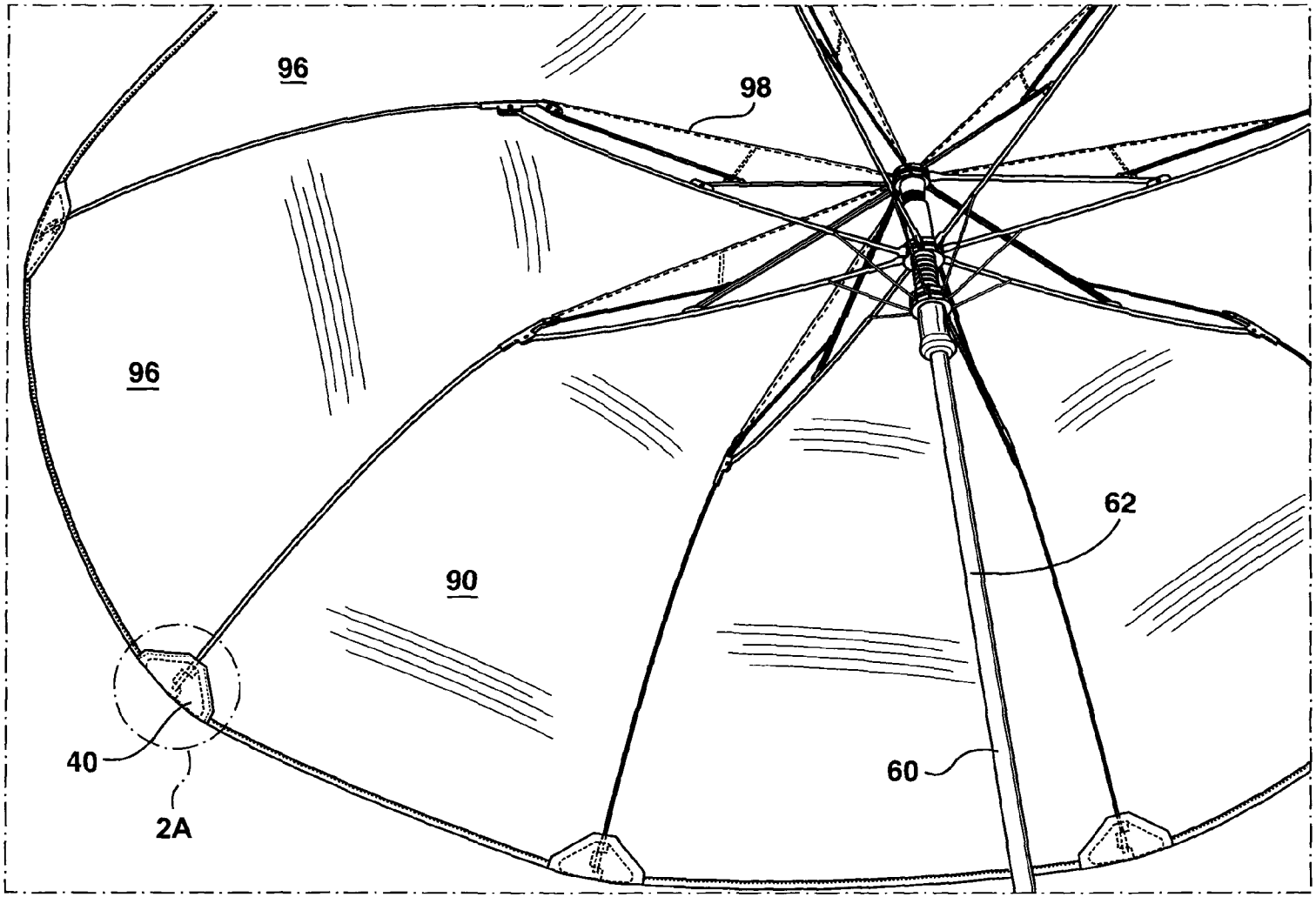
FIG. 1 is a perspective view of a first embodiment of an umbrella according to the present invention.

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. It is possible that an apparatus or method described below is not an embodiment of any claimed invention. The applicants, inventors and owners reserve all rights in any invention disclosed in an apparatus or method described below that is not claimed in this document and do not abandon, disclaim or dedicate to the public any such invention by its disclosure in this document In this specification, including the claims, for brevity, the term "umbrella" is used, and it is to be understood that this term covers any device that has a frame movable between open and closed positions, and having a canopy providing protection from one or more of rain, sun (e.g a parasol), wind and other elements stop. "umbrella" includes handheld umbrellas, patio and beach umbrellas, and umbrellas intended to be attached to various articles to protect them, such as carriages or strollers for children and to golf bags to protect golf clubs and related equipment Both an umbrella itself, and individual components of an umbrella may be movable between open and closed positions. With respect to the umbrella itself, the terms "open position" and "closed position" are used. Where an umbrella has ribs that individually have two or more rib elements, i.e. the ribs are multi-fold ribs, the different configurations of the ribs are designated by "extended position" and "folded position", and such an umbrella is described as a "multi-fold" umbrella. These terms "extended position" and "folded position" are also used to describe different positions of the tip elements of the present invention.

Reference will now be made to FIGS. 1-13, which show a first embodiment of a tip element of the present invention, indicated by the reference 40. This first embodiment is shown applied to a multi-fold umbrella, but it is to be understood that the present invention is equally applicable to and umbrella with one-piece and non-folding ribs. The umbrella is generally denoted by the reference 60, has a frame 62 and includes a main shaft 64 with the ribs 66 pivotally attached to the upper end of the shaft 64.

Figure 10:
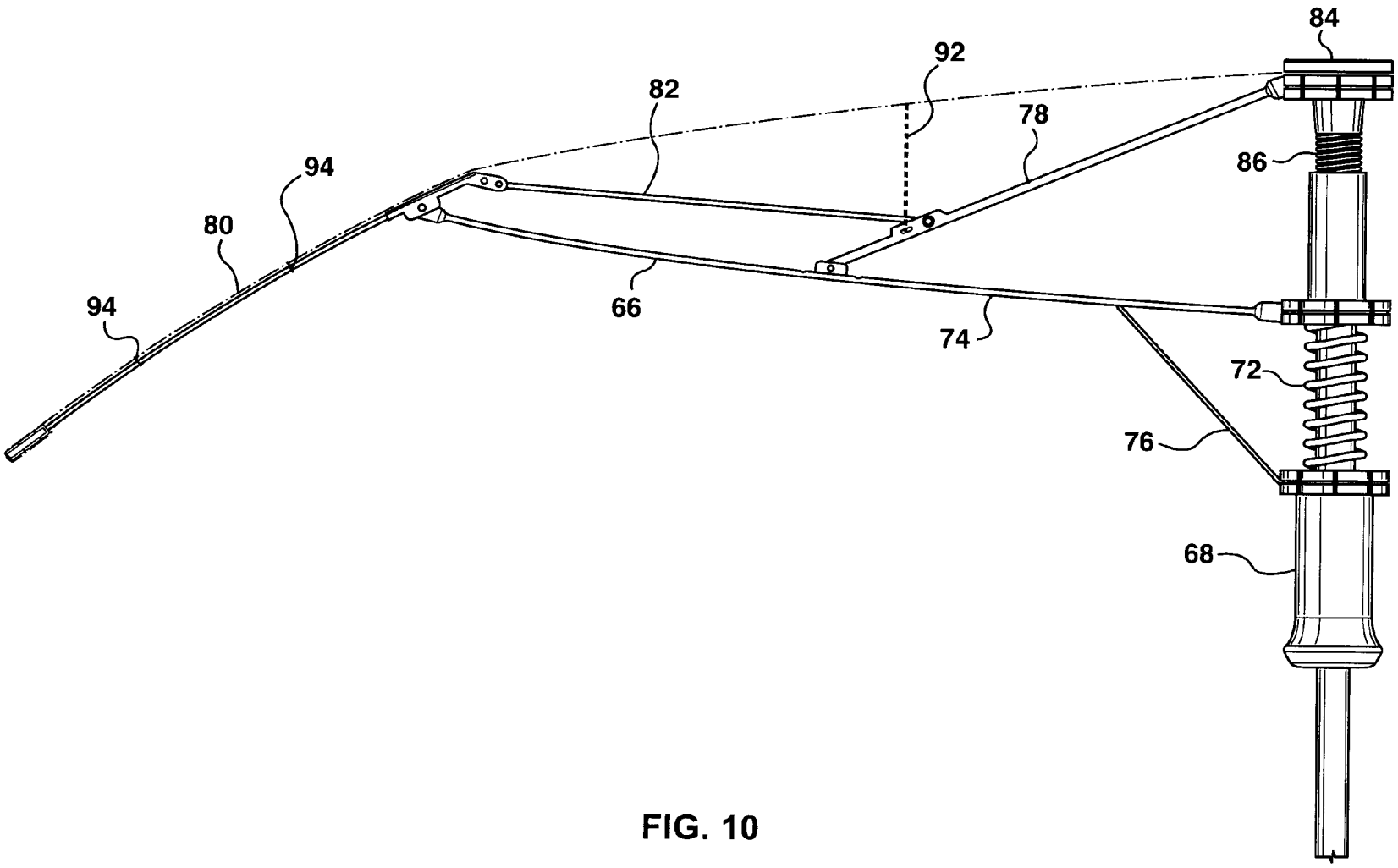
FIG. 10 is a side view of part of an umbrella frame, including tip elements according to the present invention.
Figure 11:
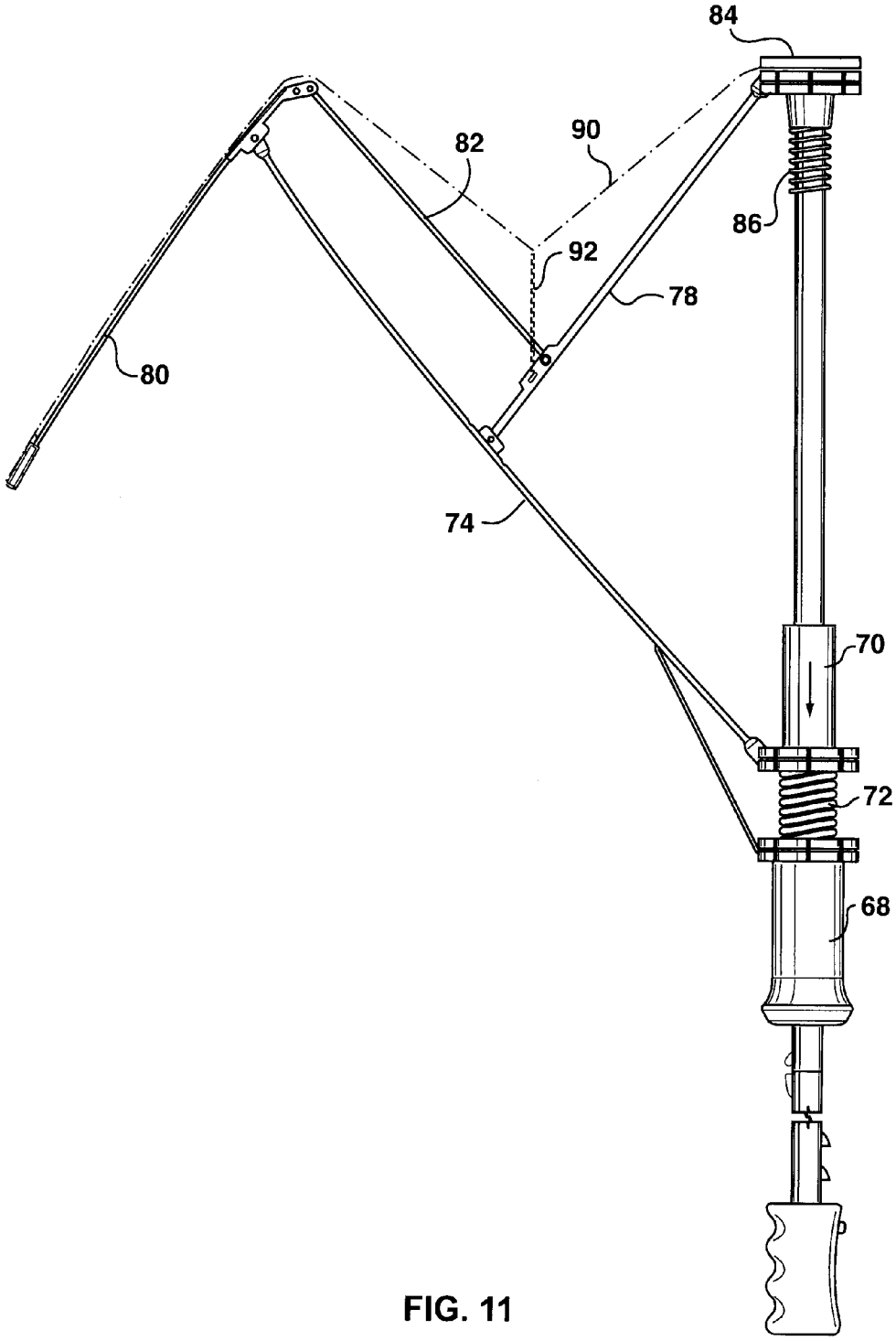
FIG. 11, is a view similar to FIG. 10, showing the umbrella frame in a partially closed configuration.
Figure 12:
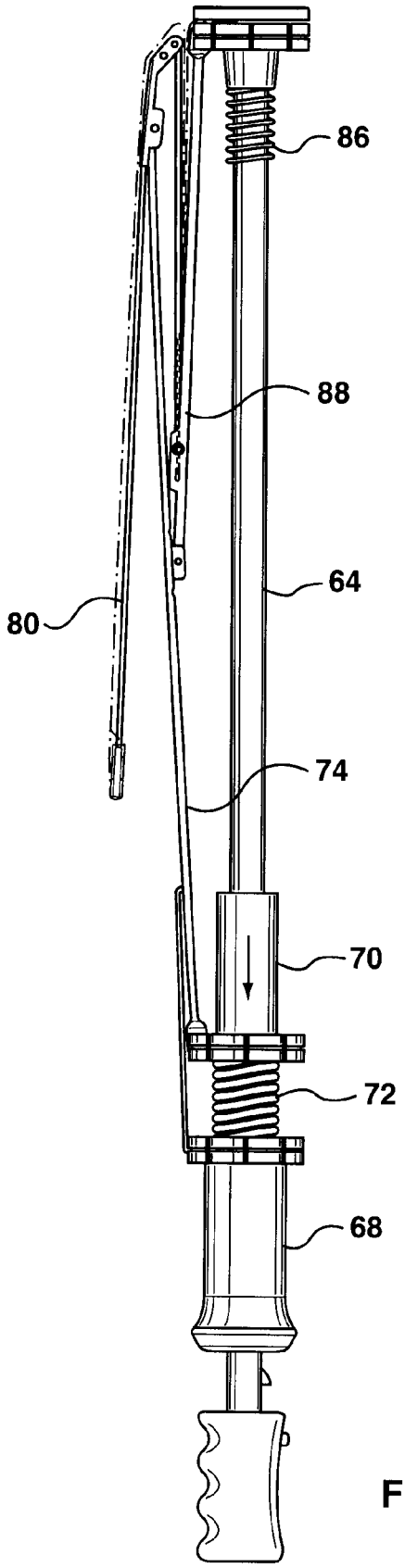
FIG. 12, is a view similar to FIGS. 10 and 11, showing the umbrella frame in a closed configuration.
Figure 13:
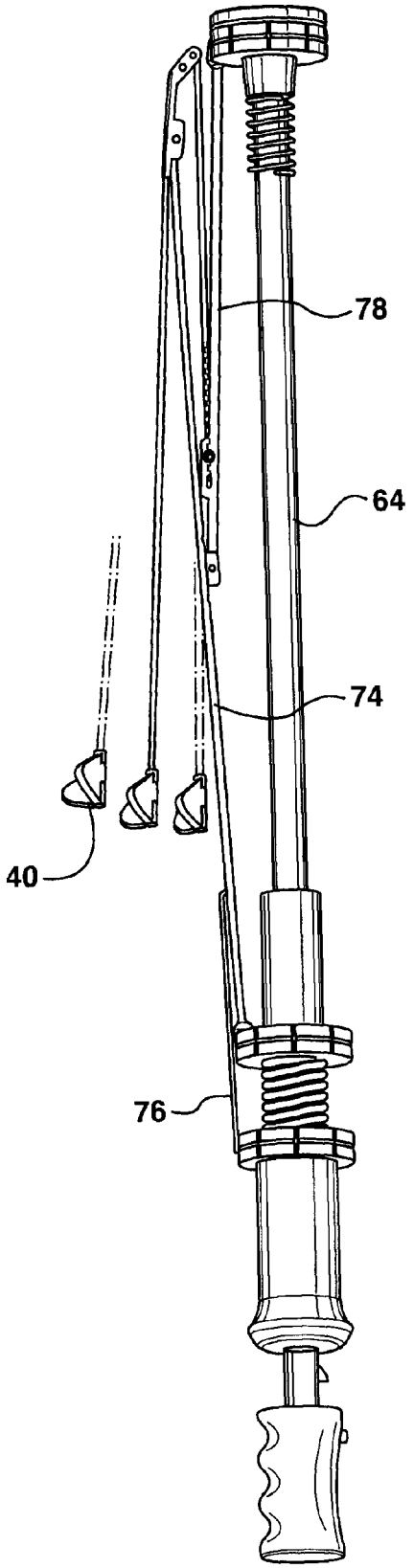
FIG. 13 is a perspective view of part of the umbrella frame showing action of the tip elements in the closed configuration.
Figure 22:
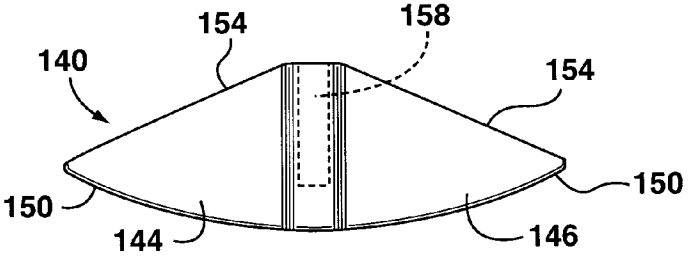
FIG. 22 is a top view of a third embodiment of the tip element.
Figure 24:
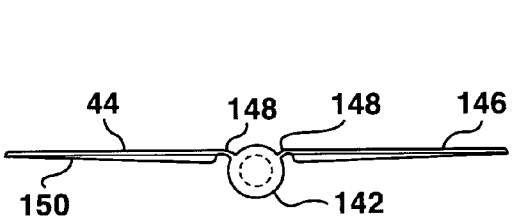
FIG. 24 is an end view of the third embodiment of the tip element, in an extended configuration.
Figure 25:
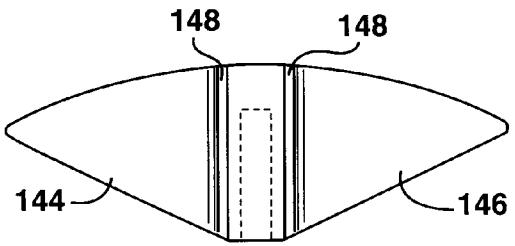
FIG. 25 is a view from underneath of the third embodiment of the tip element.

The umbrella has a first slider 68 spaced from a second slider 70 by a spring 72, that is relatively strong and is used to effect opening of the umbrella 60. The ribs 66 have inner rib elements 74, that are pivotally attached to the second slider 70. Actuation links 76 are pivotally connected to the first slider 68 and the inner rib elements 74. A comparison of FIGS. 10, 11 and 12 shows that as the umbrella 60 moves from the closed position (FIG. 12) to the open position (FIG. 10), the spring 72 is able to expand. This expansion drives the umbrella from the closed to the open position.

Each inner rib element 74 is pivotally connected to a first connecting rib 78, whose other end is pivotally connected to an element 84 at the top of the main shaft 64. An outer rib element 80 is pivotally connected to a respective inner rib element 74, at a location spaced from the inner end of that outer element 80. The inner end of each outer rib element 80 is pivotally connected to a second connecting rib 82, whose other end is pivotally connected to the first connecting rib 78, as shown.

As FIGS. 10, 11 and 12 show, the spring 72 expands and drives the sliders 68, 70 apart. The actuation links 76 pull the inner rib elements 74 down from position close to the main shaft 64 (FIG. 12), to the extended and open position (FIG. 10). As the inner rib elements 74 move to the extended, open position, they displace ends of the first connecting ribs 78 away from the main shaft 64, effectively pulling the second slider 70 towards the top of the main shaft 64; in known manner, at the top of the main shaft 64, there is the element 84, to which the first connecting ribs 78 are pivotally connected.

As the inner rib elements 74 and the first connecting ribs 78 move towards the extended position in FIG. 10, the second connecting ribs 82 cause the outer rib elements 80 to pivot and extend outwardly.

Between the top of the second slider 70 and the top element 84, there is a second spring 86, with a relatively low spring constant. It serves to cushion motion of the second slider as it moves to the extended position of FIG. 10.

Conventionally, a canopy or a cover 90, for such a collapsible or foldable umbrella, is attached to elements of the umbrella frame 62, to assist the canopy 90 in being maintained in a desired position and folding neatly. Thus, the canopy 90 may be attached to the ribs 66 at various locations 94 along the outer rib elements 80. Further, as indicated at 92, a connecting link for each rib 66, often a length of thread of like, is provided between the first connecting rib 78, adjacent the pivot connection to the second connecting rib 82 and the canopy 90. Such connections can be employed with an umbrella provided with tip elements according to the present invention.

Figure 7:
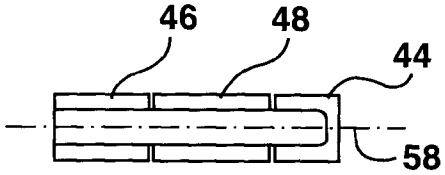
FIG. 7 is a side view, in section, of the tip element of FIG. 3.
Figure 6:
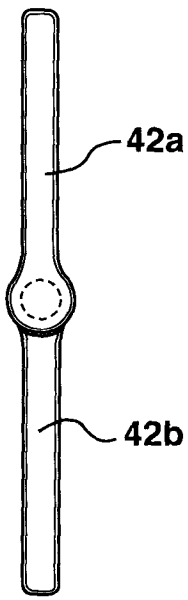
FIG. 6 is an end view of the tip element of FIG. 3, from the other end.
Figure 5:
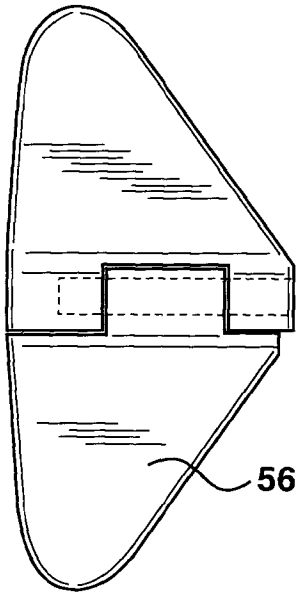
FIG. 5 is a top view of the tip element of FIG. 3.
Figure 4:
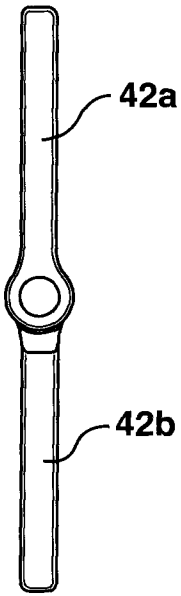
FIG. 4 is an end view of the tip element of FIG. 3, from one end.
Figure 3:
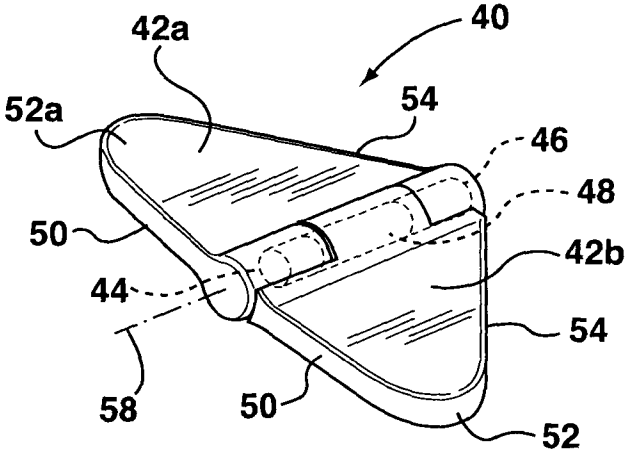
FIG. 3 is a perspective view of a tip element according to the present invention.
Figure 8:
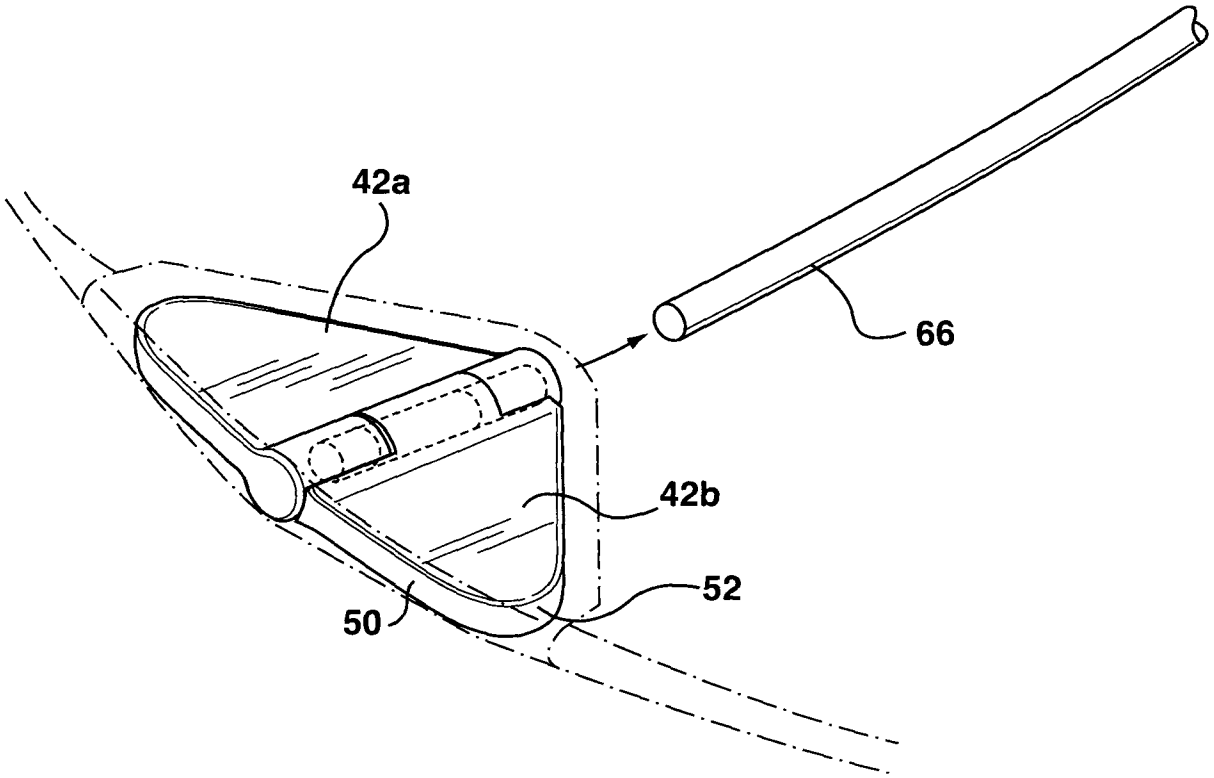
FIG. 8 is a perspective view of the tip element of FIGS. 3-7, showing mounting onto an umbrella rib.
Figure 9:
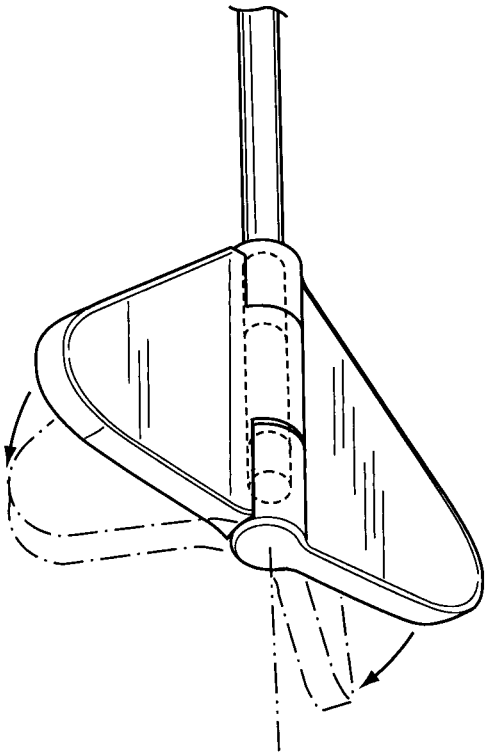
FIG. 9 is a perspective view of the tip element showing pivoting of wings of the tip element.

Turning to details of the tip elements 40, FIGS. 3-9 show details of one tip element 40. The tip element 40 has first and second wings 42*a* and 42*b*, which are of similar configuration and which are pivotally mounted on one of the ribs 66. The wing 42*a* includes two mounting portions 44 and 46, for pivotally mounting the wing 42*a* to the rib 66, and correspondingly, the wing 42*b* includes a mounting portion 48. The mounting portions 46, 48 have cylindrical bores, as best shown in FIG. 7, which also shows that the mounting portion 44 has a blind bore, for receiving the end of the respective rib 66. The first and second wings 42*a*, 42*b*, rotate about an axis that is parallel or aligned with the rib 66, so that rotation at the wings 42*a*, 42*b* is around the rib 66.

Although not shown, one of the wings 42*a*, 42*b* may include a device for retaining the tip element 40 on the end of the respective rib 66. Alternatively, each tip element 40 may include an inner component, that is secured to the end of the respective rib 66, and on which the wings 42*a*, 42*b* are pivotally mounted.

The wings 42*a*, 42*b* may have a variety of different profiles, and other profiles are shown for other embodiments of the present invention. The wings 42*a*, 42*b* have edge surfaces 50, that, as shown, form outer edge surfaces of the umbrella 60. Also, the wings 42*a*, 42*b* also include inner edge surfaces 52 and rounded tips 54, that will not directly affect the shape of the canopy of the umbrella 60, and hence may be varied in shape.

To enable the wings 42*a*, 42*b* to fold to a position, in which the wings 42*a*, 42*b* abut one another, the wings 42*a*, 42*b* may have top surfaces 56 that lie in the plane of a pivot or hinge axis 58, as in conventional hinges for doors and the like, Alternatively the wings 42*a*, 42*b* could have separate pivot connections to a common mounting portion and each could be capable of rotating through approximately 90 degrees, to enable them to pivot to a face to face position. The wings 42*a*, 42*b* could be formed from a flexible material to enable them to fold and bend as required, and as shown for later embodiments.

In conventional umbrella designs, the canopy 90 is attached to the ribs 66, usually by providing openings at the ends of the ribs 66, and simply stitching the canopy 90 to the ends of the ribs 66. The canopy 90 comprises separate pieces of fabric 96, sewn together along their edges 98 (FIG. 1). Outer edges of the pieces 96, forming an outer edge of the canopy 90, are sewn as indicated at 91

Figure 2A:
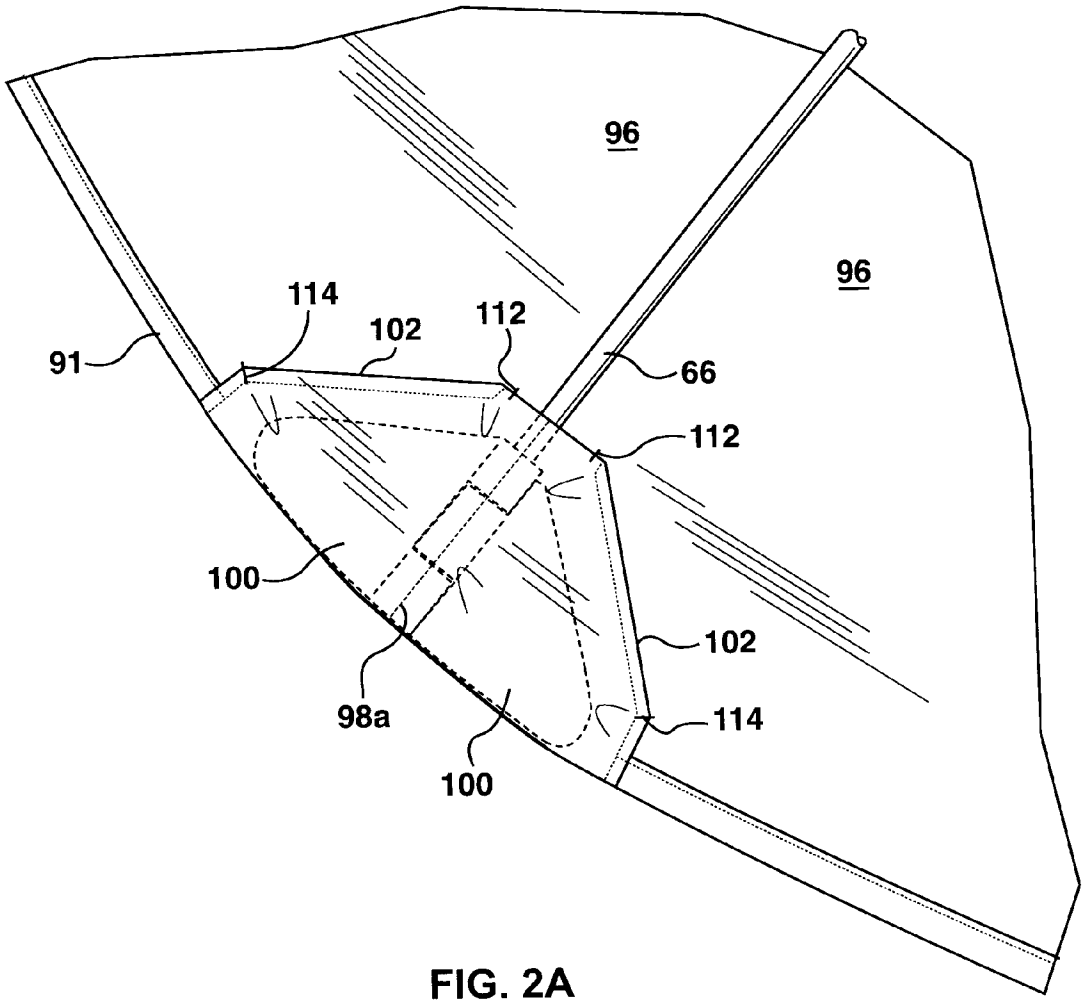
FIG. 2A is a perspective view, on a larger scale of part of the umbrella of FIG. 1.
Figure 2B:
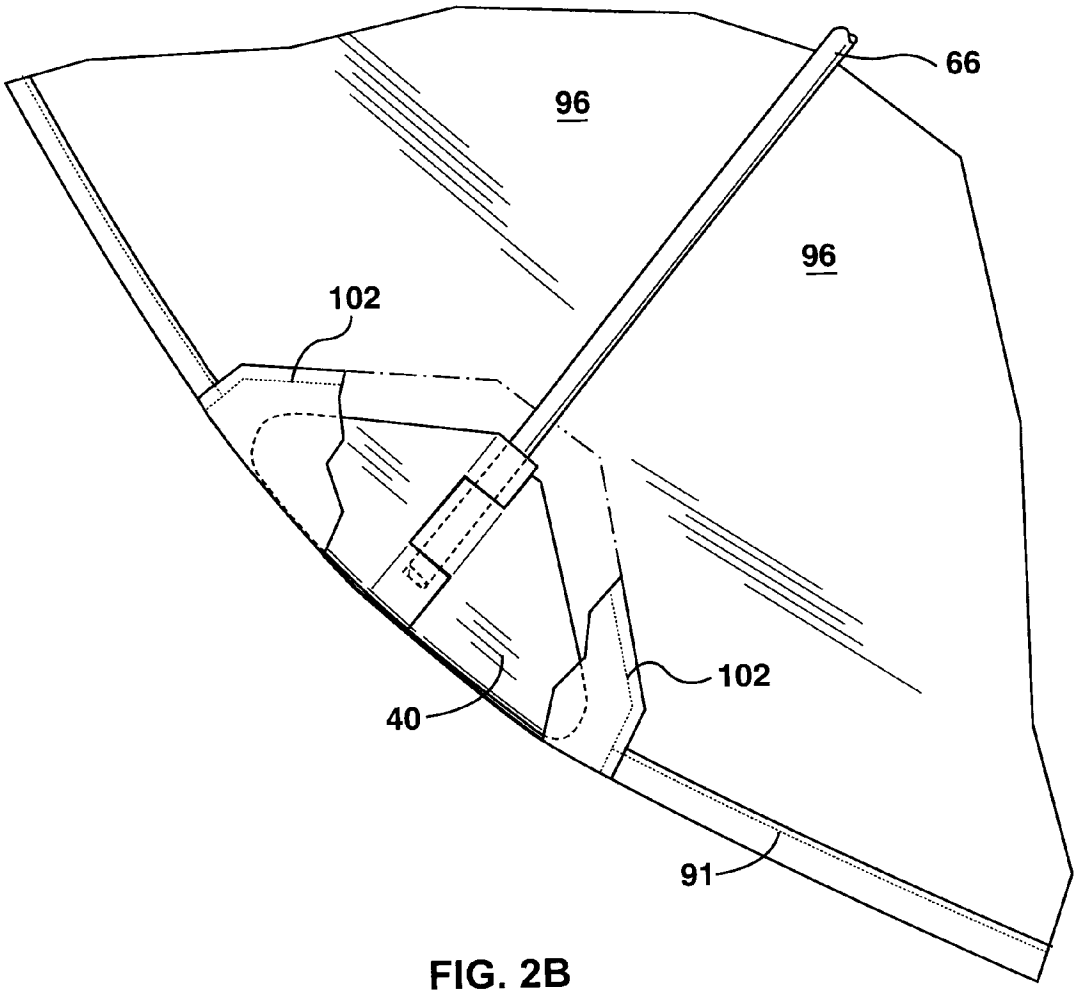
FIG. 2B is a cutaway view of the umbrella part shown in FIG. 2A.

In this embodiment, to secure the canopy 90 to the ribs 66, the canopy 90 is provided with extensions that wrap around and enclose the tip elements 40. For this purpose, each canopy piece 96 has an extension piece 100. As shown in FIG. 2*a*, at each rib 66, the extension pieces 100 are sewn together along the edges indicated at 98*a*, as an extension of the sewn edges 98. The combined pair of extension pieces 96 for each rib 66, again as best seen in FIG. 2*a*, has a generally trapezoidal shape. Further stitching, indicated at 102 secures the extension pieces 100 to the corresponding canopy pieces 96, so as to enclose the respective tip element 40. This arrangement provides a pocket for the tip element 40 (FIG. 2*b*), that also permits sufficient movement of the tip element 40, to enable the umbrella 60 to be readily moved between open and closed positions.

Figure 31:
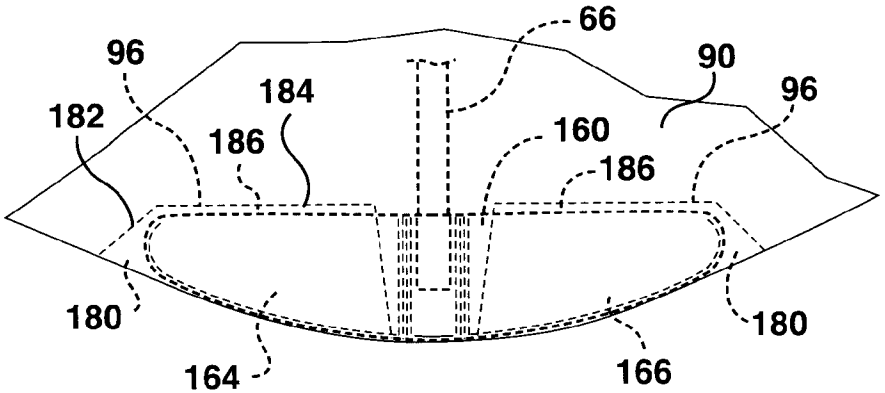
FIG. 31 is a plan view, similar to FIG. 27, showing the fourth tip element with a portion of the umbrella canopy.
Figure 32:
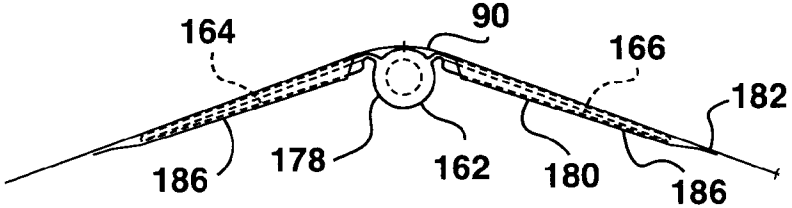
FIG. 32 is and end view, similar to FIG. 29, showing the fourth tip element and the portion of the umbrella canopy as shown in FIG. 31.

Instead of providing the extension pieces 100 as extensions of the canopy pieces 96, a separate, single extension piece could be provided at each rib 66, that is sewn to the edge of the canopy 90, and has the further stitching 102, to form the pocket enclosing the tip elements 40. Also, as shown in FIGS. 31 and 32, the stitching 98*a* could be omitted, and the extension pieces can be separate, and may be spaced apart, to accommodated folding of the umbrella.

In use, in the open position of the umbrella 60, the tip elements 40 are extended with the wings 42*a*, 42*b* generally coplanar, as shown in FIGS. 1-8. As particularly shown in FIGS. 9 and 13, the wings 42*a* and 42*b* of the tip elements 40 can fold until they generally face or abut one another, with a portion of the canopy 90 sandwiched between them. This is described further below, in relation to other embodiments. As discussed above, to enable full 180 degree movement between the wings 42*a*, 42*b* would require some additional features or changes to the wings as shown.

Further, while the wings 42 of the tip elements 40 are shown as being relatively thick, they could be thinner and could taper towards the rounded tips 54. Additionally, the wings 42 may be moulded in a plastic material. With appropriate selection of material and thickness of the wings 42, the tip elements 40 can be sufficiently stiff to support the edge of the canopy 90, while simultaneously having sufficient flexibility to enable them to wrap around the main umbrella shaft 64 in the closed position. This is described in more detail below for other embodiments.

Reference will now be made to FIGS. 14-21, which show a second embodiment of the present invention. Here, a tip element is indicated generally at 120, and is integrally moulded in a plastic material in one piece.

The tip element 120 has a central mounting portion 122. Extending from the central mounting portion 122 is a first wing 124. On the other side of the central mounting portion 122, there is a second wing 126 connected to the mounting portion 122 by a living hinge 128. The central mounting portion has a blind bore 138, for mounting on a rib 66.

The wings 124, 126 have edges 130, 132 that define an outer edge of the canopy 90. As indicated at 134, the wings 124, 126 and the mounting portion 122 provide inner edges, whose exact profile is not critical. The wings 124, 126 may be wide enough to provide adequate support for the canopy edge.

The outer edges 130, 132 may be generally arcuate, either with a constant radius or a varying radius. Where there is a varying radius, the radius close to the rib 66 can correspond to the length of the rib 66, as the length of the rib 66 is an indication of the radius of the canopy 90; it will also be understood that a conventional canopy 90 does not have perfectly circular outer edge, and usually the edge, between each adjacent pair of ribs 66, is incurved or indented Thus, the canopy 90 is usually not perfectly circular and thus does not have a precise radius, but the radius of the ribs 66 is generally indicative of the average radius of the canopy 90. The radius of the outer edges 130, 132 then may decrease away from the rib 66, so that these edges turn away slightly from the edge 91 the canopy 90. Where the edges 130, 132 have a constant radius this may be the length of each rib 66, or less than the length of each rib.

As shown at 136, both wings 124, 126 may taper away from the mounting portion 122. As detailed below, this can give the wings 124, 126 sufficient flexibility, for them to wrap to some extent around the main shaft 64 in the folded position.

FIG. 17 indicates the action of the living hinge 128, when each tip element 122 moves from an extended position (FIGS. 14, 15, 18 and 20) to a folded position. The second wing 126 hinges about an axis of the living hinge 128 until it comes close to or abuts the first wing 124. As FIG. 19 shows, a portion of the canopy 90 will be sandwiched between the wings 124, 126.

The tip elements 120 can be attached to the canopy 90, either as detailed for the first embodiment, or as detailed below in relation to later embodiments.

FIG. 21 shows, schematically, behaviour of the tip elements 120 of the second embodiment. In the closed position, the ribs 66 are close to and generally aligned with the main shaft 64. The dimensions of the tip elements 120 may be such that, in the folded position, the tip elements 120 overlap one another, as the folded portions of the canopy 90 are wrapped around the shaft 64 in known manner. As shown in FIG. 21, by providing the tip elements 120 with sufficient flexibility, particularly at the tips thereof, they have the ability to wrap around each other.

Reference will now be made to FIGS. 22-26 which show a third embodiment of the present invention, generally indicated by the reference 140. Like the second embodiment, this third embodiment is intended to be integrally moulded in plastic, in one piece.

Here, each tip element 140 has a mounting portion 142, from which extend first and second wings 144, 146. Both wings 144, 146 are connected to the mounting portion 142 by living hinges 148. The wings 144, 146 have edges 150 that define an edge of the canopy and 90. The mounting portion 142 has a blind bore 158 for mounting on the end of a rib 66. The living hinges are parallel or aligned with the rib 66, so flexing or pivotal movement of the wings 144, 146 is around the rib 66. Similarly to the first and second embodiments, the mounting portion 142 and the wings 144, 146 have inner edges 154, whose exact shape does not affect the shape of the canopy; the shape of the edges 154 may be determined by the required characteristics of the tip elements 140.

Figure 26:
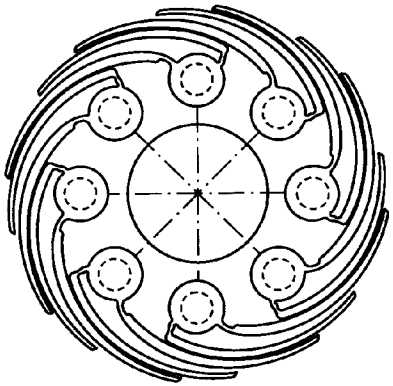
FIG. 26 is an axial view, in partial section of an umbrella including tip elements of the third embodiment, shown in a closed position.
Figure 23:
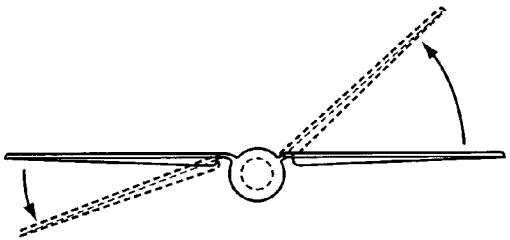
FIG. 23 is an end view of the third embodiment of the tip element, showing pivoting of wings thereof.

FIG. 26 again shows schematically behaviour of these tip elements 140 in the closed position of an umbrella. As shown, the wings 144 may flex to some extent about their respective living hinges 148. As for the second embodiment, the second wings 146 will pivot through nearly a semicircle, when moving from an extended position to the folded position. Again if the materials off the tip elements 140 and their dimensions are chosen appropriately, the wings 144, 146 may flex to wrap around each other as shown in FIG. 26.

Reference now be made to FIGS. 27-33, which show a fourth embodiment off a tip element, indicated by the reference 160. This fourth embodiment 160 has many similarities with the third embodiment 140, in that it is intended to be moulded from a plastic material, to be integrally formed in one piece, to have two living hinges, and to be generally symmetrical.

The tip element 160 has a central mounting portion 162, from which extend first and second wings 164, 166. The wings 164, 166 are connected to the central mounting portion by living hinges 168. A blind bore 178 is provided in the central mounting portion, for mounting each tip element 160 onto one of the ribs 66.

Figure 27:
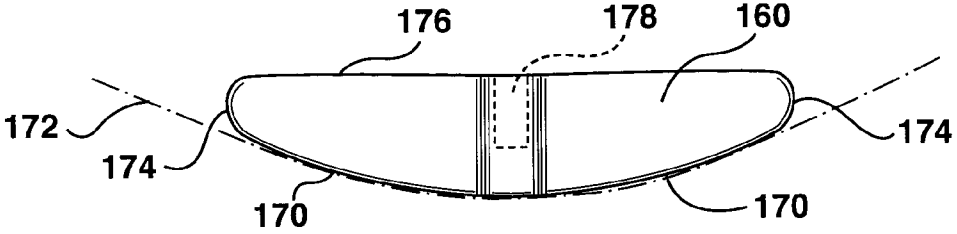
FIG. 27 is a top view of a fourth embodiment of the tip element.
Figure 29:
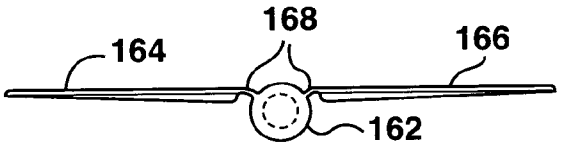
FIG. 29 is an end view of the fourth embodiment of the tip element, in an extended configuration.
Figure 30:
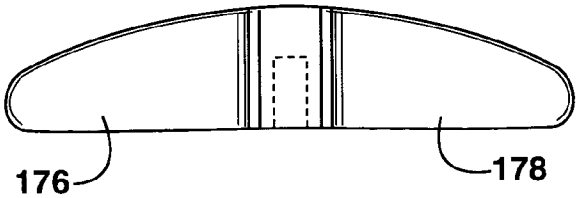
FIG. 30 is a view from underneath of the fourth embodiment of the tip element.
Figure 28:
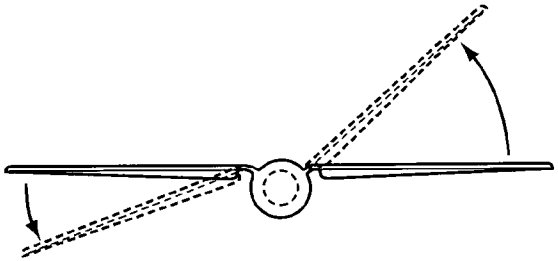
FIG. 28 is an end view of the fourth embodiment of the tip element, showing pivoting of wings thereof.

Wings 164, 166 have edges 170 that define an edge of the canopy 90 indicated by the dotted lines 172 in FIG. 27. The wings 164, 166 also have rounded tips 174. The wings 164, 166 and the central mounting portion 162 have a straight inner edge 176.

As shown in FIGS. 31 and 32 in particular, instead of a complete pocket enclosing each tip element 160, the canopy pieces 96 can be provided with separate extensions 180, that fold under the canopy 90 and are not sewn together. As shown in FIG. 31 each extension 180 may be sewn to its corresponding canopy piece 96 along edges 182 and 184, to define a pocket 186 for one of the wings 164, 166. As shown in FIG. 32 this then leaves an end of the central mounting portion 162 exposed, and facilitates folding of the wings 164, 166.

Figure 33:
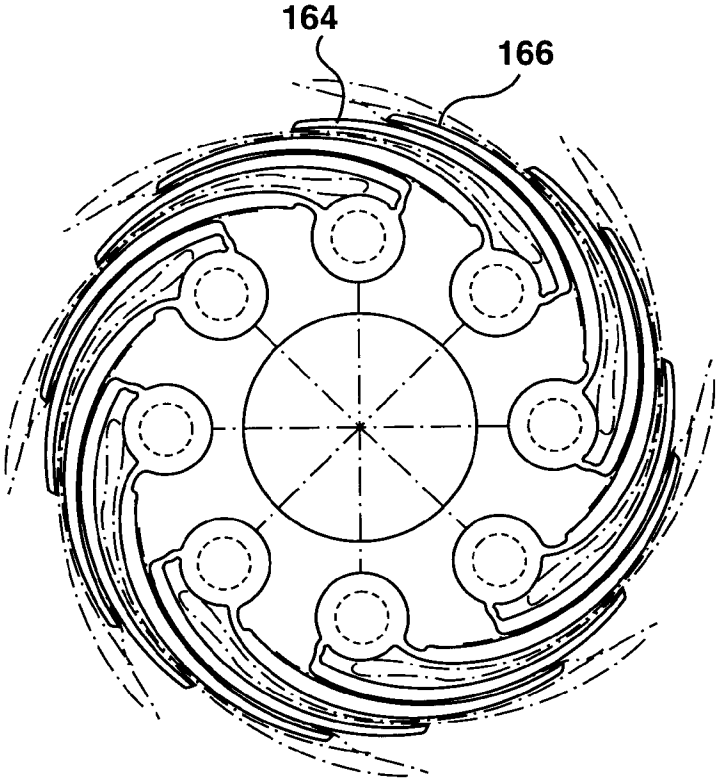
FIG. 33 is an axial view, in partial section of an umbrella including tip elements of the fourth embodiment, shown in a closed position.

FIG. 33 then shows the configuration in the closed position. As for the previous embodiment, the wings 164, 166 wrap around one another. Portions of the canopy are shown at 90.

Referring back to FIGS. 2*a*, 2*b*, instead of providing a full pocket 110, it may be possible to simplify the stitching. As indicated at 112, it may be sufficient just to stitch the extension pieces 100 to their corresponding canopy pieces 96, close to the respective rib 66. Further, the extension pieces 100 may be stitched to the canopy pieces 96, as indicated at 114, adjacent the outer edge of the canopy 90. With appropriate shaping of the extension pieces 100, it may be possible to omit the stitching 114.

Figure 34:
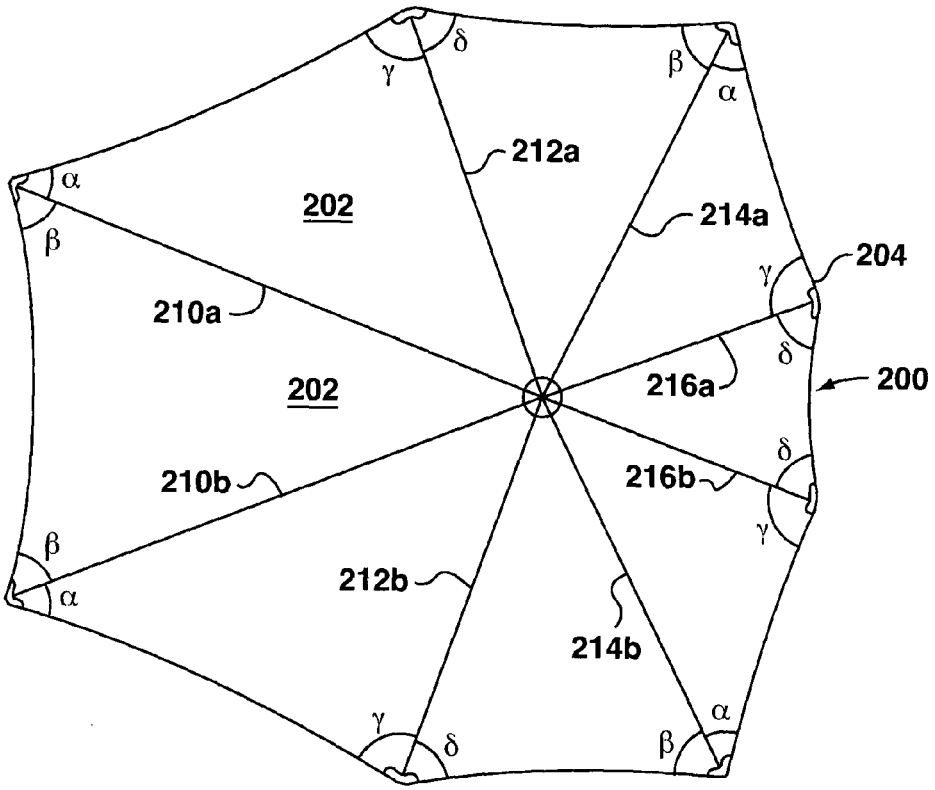
FIG. 34 is a plan view of an asymmetric umbrella, including tip elements in accordance with a fifth embodiment of the present invention.
Figure 35:
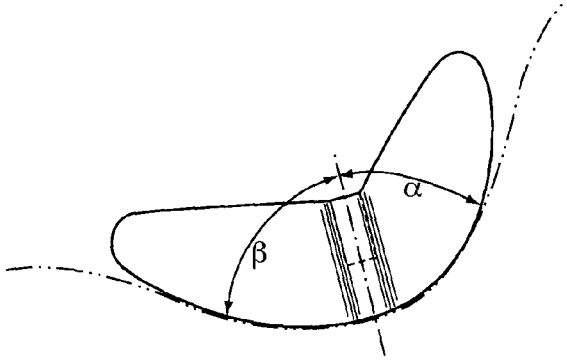
FIG. 35 is a plan view of the fifth embodiment of an asymmetric tip element for use with the asymmetric umbrella of FIG. 34.

Reference will now be made to FIGS. 34 and 35, which show an asymmetric umbrella, that may be generally in accordance with the disclosure in published PCT application WO2006/132525. In view of the asymmetric canopy, indicated at 200, the canopy pieces, here indicated at 202, have different shapes. With respect to the tip configurations, the angles of the outer edges of the canopy pieces to the ribs, indicated at 204, vary. These angles are indicated as α, β, γ and δ. It will also be understood that the outer edges of the canopy pieces 202 are incurved and do not present precise angles, so these indicated angles are approximate; more particularly the indication of angles being equal may only be an approximation.

As indicated, there are three different rib lengths in this configuration, namely: two long ribs 210; a first pair of medium length ribs 212 and a second pair of medium length ribs 214; and a pair of short ribs 216. To further distinguish the individual ribs, the suffixes a, b are used.

Reviewing the angles of the canopy 200 at the various rib ends, and again recognizing that these angles are only approximate, will show some similarities for different rib ends. It can also be noted that, in the context of the present invention, a tip element for this or other type of umbrella could have a curved edge that extends through a significant arc, so that it can be used with a variety of different canopy profiles; different canopy profiles can engage more or less of the arc length of each tip element to accommodate variations in these angles.

Thus at the end of one of the longer ribs 210*a* there are angles α and β, that approximately match the angles found at the end of rib 214*a*, which are accordingly also indicated as α and β. Corresponding and mirror image angles β and a are found at the end of ribs 210*b*, 214*b*. Similarly angles γ and δ are found at the end of rib 212*a* that approximately match the angles also indicated as γ and δ at the end of rib 216*a*. Ribs 212*b* and 216*b* have these same angles δ and γ, again as mirror image of these angles at the ends of ribs 212*a* and 216*a*.

Consideration of these different angles will show that while they may necessitate provision of asymmetric tip elements, this may not always be necessary. Firstly, it may be possible to provide tip elements with outer edges, that have an arc length or extend through a sufficient angle to accommodate all the angles α, β, γ and δ, with, as mentioned, the canopy engaging different lengths of the outer edge as required.

Alternatively, if different tip elements are to be provided, noting the approximate equivalence in the angle patterns enables a reduced number of different tip elements to be provided. Thus, there can be provided: one configuration of asymmetric tip element for the ribs 210*a*, 214*a*; another, mirror image configuration for ribs 210*b*, 214*b*; another for ribs 212*a*, 216*a*; and another for ribs 212*b*, 216*b*, that is mirror image to that for ribs 212*a*, 216*a*. In particular, it can be noted that the angles γ and δ are quite similar, and could possibly be treated as the same, which would simplify the design, as the a common tip element could be used at least for the four ribs with the angles δ and γ.

The reference will now be made to FIGS. 36, 37, which show a sixth embodiment of the present invention, indicated at 200. The sixth embodiment 200 has ribs, one being shown at 202. A canopy is shown at 204, and in this embodiment, the canopy 204 is formed from a plastic material, that is preferably transparent, but it may be opaque or bear a printed design. Although not shown, plastic canopies are usually formed from a number of separate pieces, each being generally triangular and having edges that are aligned with the ribs 202. The separate pieces are joined together by plastic welding, to form a continuous and waterproof joint.

In this sixth embodiment, each rib 202 is fitted with a tip element 210. Each tip element 210 has a mounting portion 212, dimensioned for a tight, secure fit on the end of one of the ribs 202. Two wings 214 are joined to the mounting portion 212 by living hinges 216, as in the earlier embodiments.

Figure 36:
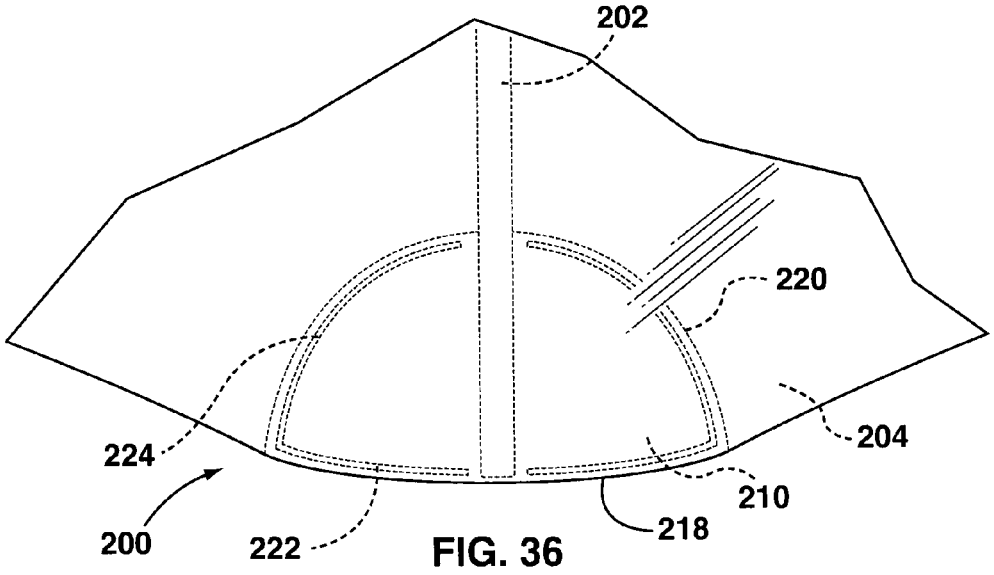
FIG. 36 is plan view of a part of an umbrella showing a sixth embodiment of the tip element.
Figure 37A:
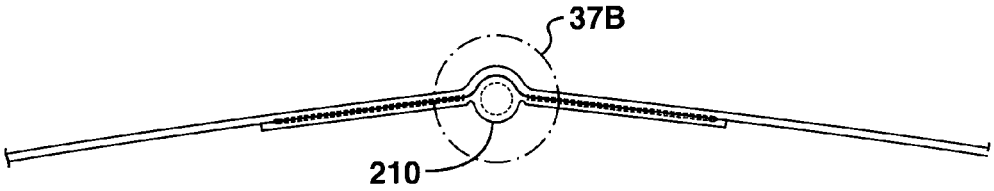
FIG. 37A is view along a rib of the umbrella of FIG. 36.

To attach the canopy 204 to the tip elements 210, the canopy is welded, by plastic welding, as indicated at 222, 224 in FIG. 36. The exact pattern of the welded joints 222, 224 can be varied, and need not necessarily be continuous.

As shown in FIG. 36, with a canopy 204 attached, each tip element 210 provides a rounded outer edge 218, and is also shaped to provide a rounded inner edge 220. The edges 218, 220 can be shaped to provide an approximate a semicircular shape.

Figure 37B:
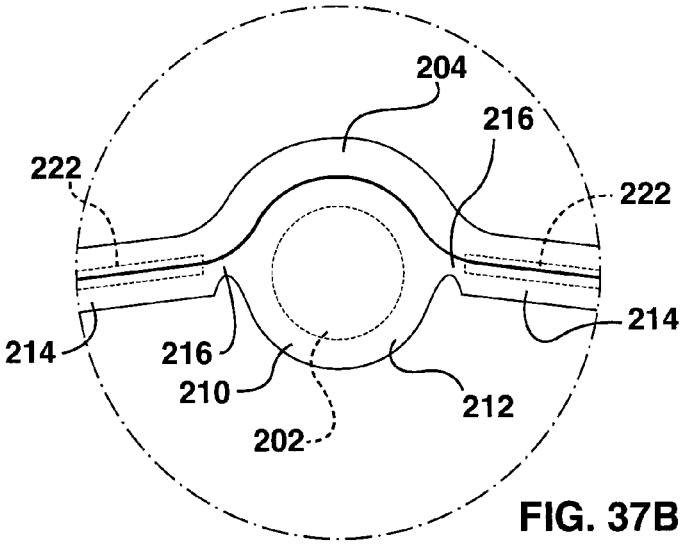
FIG. 37B is a view similar to FIG. 37A on a larger scale.

As FIG. 37B shows, the canopy 204 passes over the top of the wings 214 and the mounting portion 212, when the wings 214 are in an extended configuration. When the umbrella is closed, the wings 214 will pivot downwardly, as viewed in FIGS. 37A, B into a folded position. Accordingly, the welded joints 222, 224 should be located such as to provide sufficient slack in the portion of the canopy passing over the mounting portion 210, to enable the wings 214 to be folded to the folded position, without stressing the canopy excessively.

Reference now be made to FIG. 38 and FIG. 39, which show variants of the sixth embodiment of the tip element. For simplicity and brevity, the same reference numerals are used to describe the same elements in these figures; the description of these elements is not repeated.

In all these variants (and also in the sixth embodiment of FIGS. 36, 37), the tip elements are formed from plastic and are joined to the plastic canopy by plastic welding. It is envisaged that the canopy will be at least partially transparent or translucent, preferably fully transparent, so that the shape of the tip elements will be clearly visible. In these variants, the tip elements are provided with shapes that, in addition to the function of providing a rounded edge to each rib, also add a significant design feature to the umbrella. Additionally, each tip element can have any desired colour, that may be solid and constant, or itself may vary and show a design within each tip element. For example, the tip elements can be bright or fluorescent red, orange or other colour, so as to make the umbrella more visible. As detailed below in relation to FIG. 38C, one or more portions of tip element may be at least partially transparent, so as to enable the visually apparent shape, to be different from the functional shape that alters the function of the umbrella, and in particular may soften the edge of the canopy.

Figure 38A:
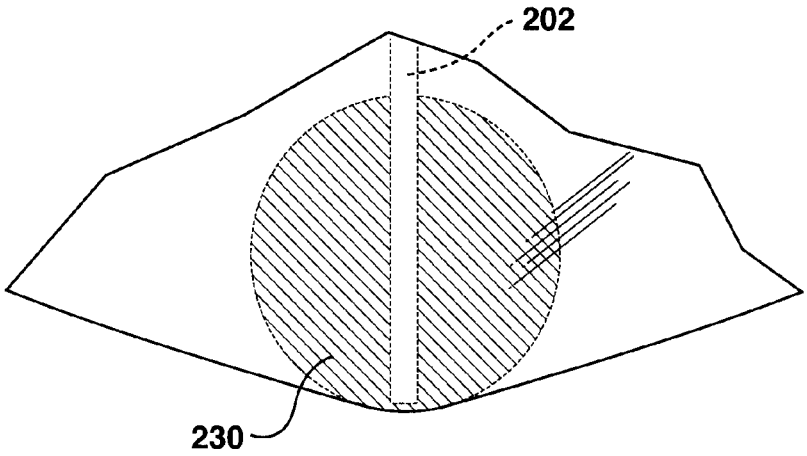
FIGS. 38A, 38B, 38C, 39A, 39B and 39C are views similar to FIG. 36 showing variants of the sixth embodiment of the tip element.

In FIG. 38A, a tip element 230 is provided that it is generally circular.

Figure 38B:
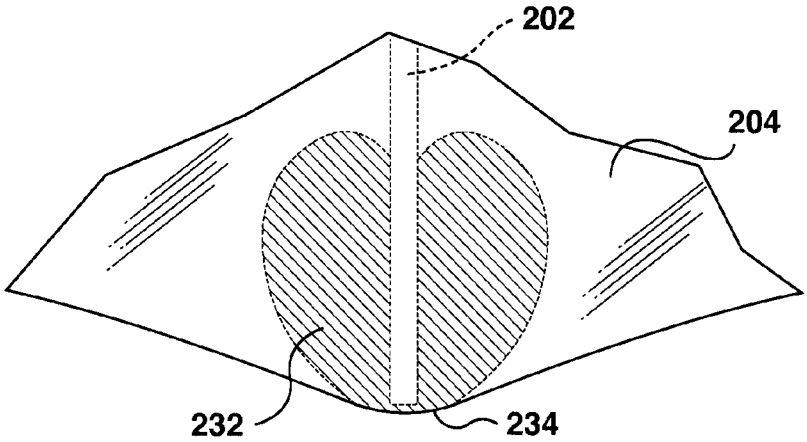

In FIG. 38B, a tip element 232 is provided that it is generally heart-shaped. What is normally the bottom of the heart can be slightly rounded, as shown, so as to provide a rounded, softened edge 234 for the respective rib 202.

Figure 38C:
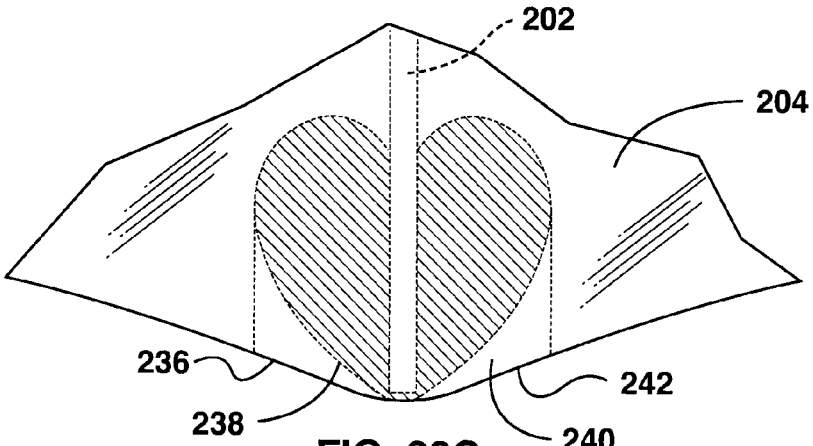

FIG. 38C shows a third variant, which also provides a tip element 236 showing a general heart shape. Here, the tip element 236 has an opaque or solid (in the visual sense) portion 238 and transparent portions 240. While this may slightly complicate the design of the tip element 236, it does enable the solid or opaque portion 238 to have a more exact heart shape. The transparent portions 240 then enable a desired rounded edge 242 to be provided.

The fourth, fifth and sixth variants all show designs taken from nature, and it will be appreciated that a large variety of designs can be used, including other designs taken from nature, geometric designs, abstract designs, etc. All these designs take advantage of the transparent nature of the canopy to add a design feature to the umbrella.

Figure 39A:
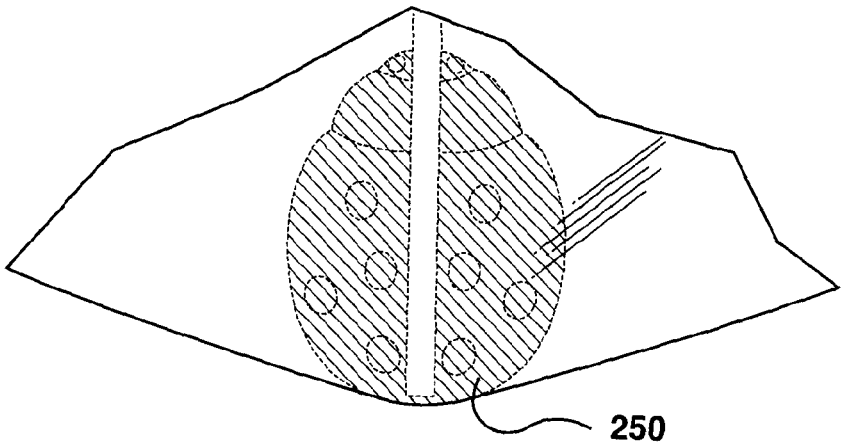
Figure 39B:
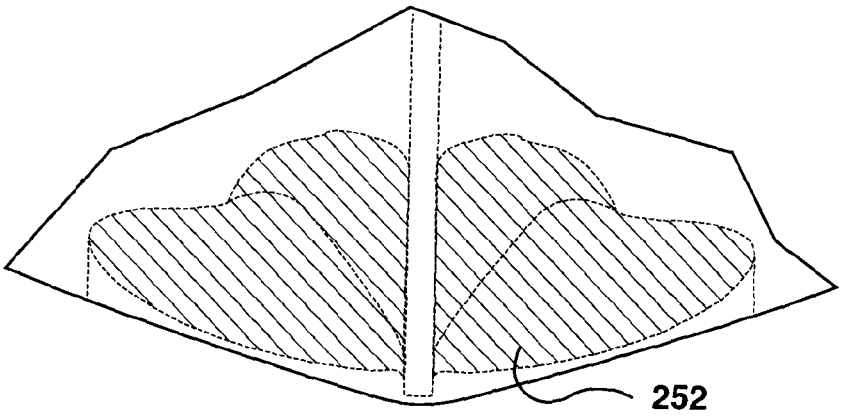
Figure 39C:
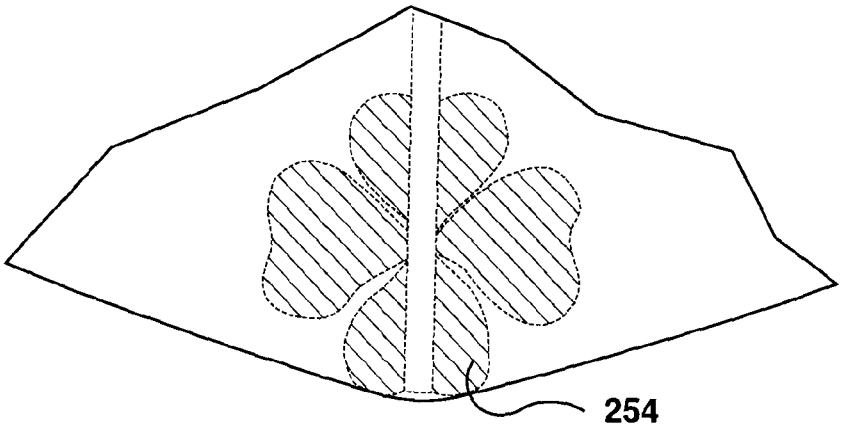
Figure 40:
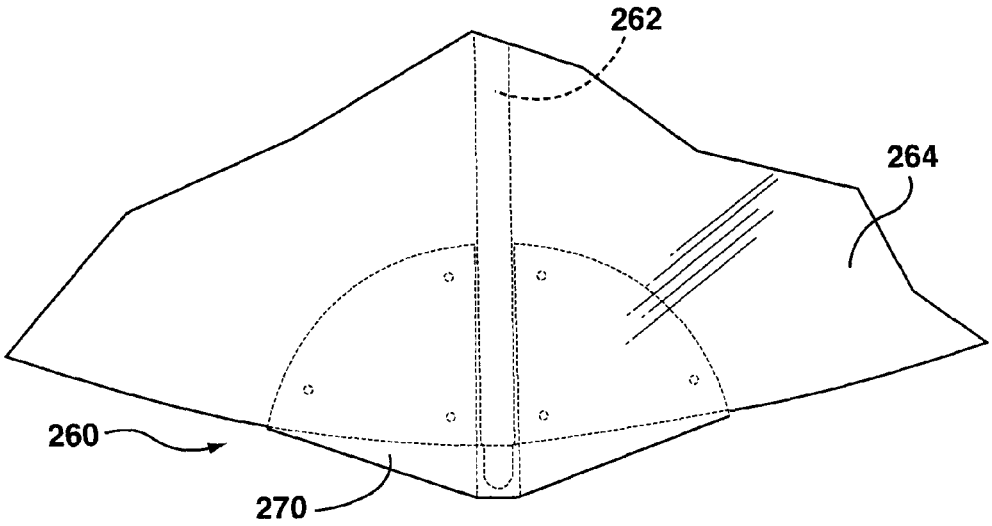
FIG. 40 is a view similar to FIG. 36 showing a seventh embodiment of the tip element.
Figure 41:
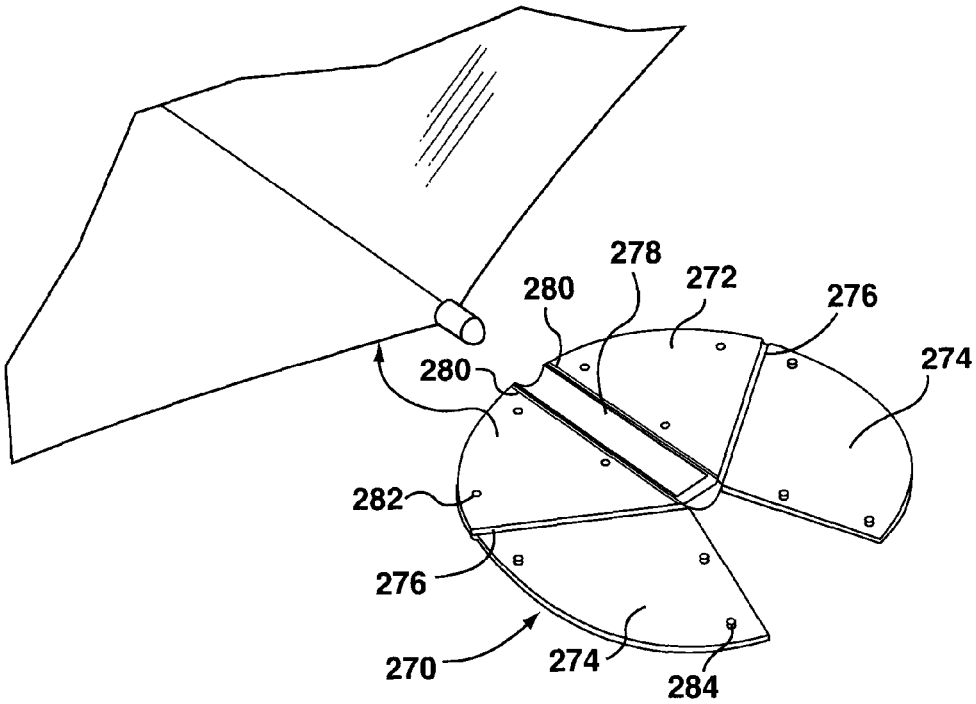
FIGS. 41, 42 and 43 are perspective views of the seventh embodiment of the tip element of FIG. 40, showing a method of attachment.

In FIG. 39A, a tip element 250 has a shape showing a ladybug. In FIG. 39B, a tip element 252 has the shape of a butterfly or other flying insect, and it will be understood that a wide variety of different butterfly shapes can be employed. FIG. 39C shows a sixth variant of the tip element 254, that has the shape of a clover leaf.

Reference now be made to FIGS. 40 to 44 which show seventh embodiment of the tip element. This embodiment is generally indicated at 260 with the seventh embodiment of the tip element itself indicated at 270. One rib is shown at 262 and the canopy is indicated at 264. In this embodiment, the tip elements 270 are intended to be fitted to the edges of the canopy 264 by individual users after the umbrella has been made and sold. In other words, it is anticipated that these tip elements 270 would be sold in packages, with a sufficient number for a single umbrella, to individual consumers, for fitting to existing umbrellas. They can provide both a safety factor to the umbrella and also add a design element. It will be appreciated that, as detailed below, the top of the tip elements 270 will be visible, and so they can be given any desired design shape, colour, pattern, etc., including those shown in other figures.

Each tip element 270 comprises a base, or more generally main, portion 272 and a pair of top, or more generally complementary, portions 274, joined to the base portion by living hinges 276. The base portion has a central portion 278, that may be configured as a channel 278 to fit around the end of the rib 262, and living hinges 280, so that side elements on either side of the channel 278 can pivot relative to the channel 278 and to each other. The living hinges 276 join the complementary or top portions to the side elements. In some embodiments the living hinges could be omitted, and the tip element as a whole is then made sufficiently flexible, so as to be capable of wrapping around the umbrella, in the closed position, as shown in FIG. 33, for example Referring to FIGS. 41, 42, 43 and 44, a description will be given of the mounting of each tip element 270 the umbrella. The tip element 270 is presented in an open configuration as shown in figure FIG. 41. The end of the rib 262 is fitted in to be channel 278, with an edge portion of the canopy 264 overlying the base portion 272.

Figure 42:
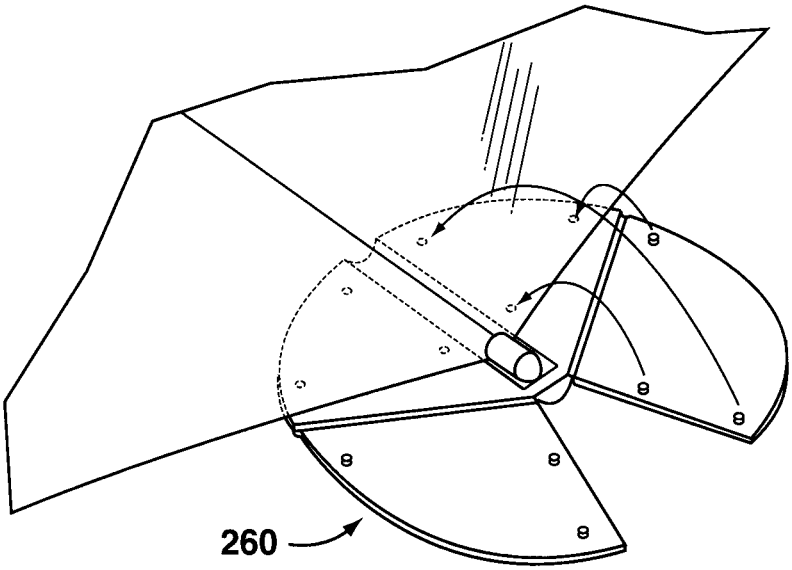

The top portions 270 are then pivoted about the living hinges 276, as indicated by the arrows in FIG. 42. The base portion 272 is provided with holes 282, and the top portions 274 have complementary projections 284. As the top portions 274 are pivoted into the position shown in FIGS. 43, 44, the projections 284 each pass through into a corresponding one of the holes 282. As the projections 284 engage the holes 282, they engage portions of the canopy 264, as shown in FIG. 44. The holes 282 and projections 284 are dimensioned so as to provide a snap fit, with an allowance for the thickness of a typical canopy.

Figure 43:
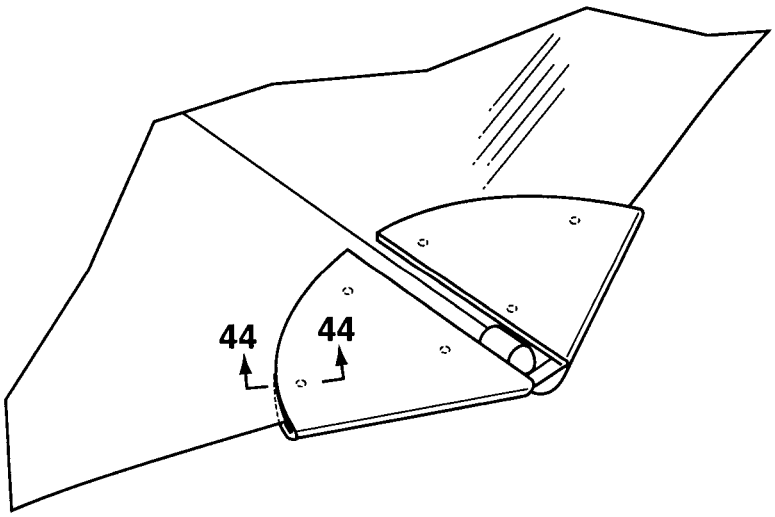
Figure 44:
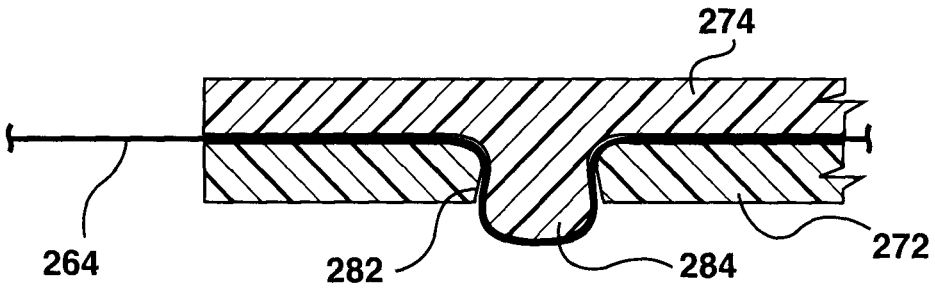
FIG. 44 is a sectional view along line 44-44 of FIG. 43 showing details of the seventh embodiment of FIGS. 40-43.

With each tip element 274 attached to the canopy to 64 as shown in FIG. 43, effectively two wings are formed, and the living hinges 280 enable them to pivot about the rib 262 and the channel 278, as in other embodiments. It will also be understood that the base portion 272 and the top portions 274 may be reversed, so that a top view will then show a continuous element, with the two folding elements, the top portions 274 as shown, then folded underneath.

These tip elements 270 can be removed and exchanged as desired. The fastening as shown in FIG. 44 can be such as not to permanently damaged or distort the canopy, so that the tip elements 270 can be removed and discarded, or they can be replaced with tip elements of an alternative shape or colour.

With respect to various embodiments shown with living hinges, each of these hinges could be a conventional hinge. In other words, each wing and its mounting portion could be provided with bores, and then connected by a hinge pin.

The present invention generally can be used with any type of umbrella construction, that may have ribs or spokes formed from steel, aluminum, other metals, wood, fiberglass, and other reinforced and plain plastics, for example.

Instead of providing discrete hinge locations for each wing, or one wing, either as living hinges or conventional hinges, it may be sufficient to make the wings sufficiently flexible that they can wrap around the main umbrella shaft as shown in FIGS. 21, 26 and 33.

PARTS LIST

40 Tip element
42 Wing, Wing 42*a*, Wing 42*b*
44 Mounting Portion (of wing 42*a*)
46 Mounting Portion (of wing 42*a*)
48 Mounting Portion (of wing 42*b*)
50 Edge Surface (outer)
52 Inner edge surface
54 tip (rounded)
56 top surface
58 hinge axis
60 umbrella
62 frame
64 main shaft
66 ribs
68 first slider
70 second slider
72 spring
74 inner rib elements
76 actuation link
78 first connecting rib
80 outer rib element
82 second connecting rib
84 element at top of main shaft 64
86 second spring
90 canopy
92 connecting link
94 connection to outer rib element 80
96 canopy piece
98 sewn edge
100 extension piece
102 further stitching
110 pocket
120 tip element
122 mounting portion
124 first wing
126 second wing
128 living hinge
130 edge
132 edge
134 inner edge
136 taper for wings 124, 126
138 bore (blind)
140 tip element
142 mounting portion
144 first wing
146 second wing
148 living hinge
150 edge
152 (not used)
154 inner edge
156 (not used)
158 bore (blind)
160 tip element
162 central mounting portion
164 first wing
166 second wing
168 living hinge
170 edge
172 edge of canopy (shown stippled/dotted)
174 rounded tip
176 straight inner edge
178 bore (blind)
180 extension
182 sewn edge
184 sewn edge
200 sixth embodiment
202 rib
204 canopy
210 tip element (sixth embodiment)
212 mounting portion
214 wing
216 living hinge
218 outer edge of tip element
220 inner edge of tip element
222 weld
224 weld
230 first variant of sixth embodiment of tip element
232 second variant of sixth embodiment of tip element
234 outer edge of second variant of sixth embodiment of tip element
236 third variant of sixth embodiment of tip element
238 solid portion of third variant
240 transparent portion of third variant
242 rounded edge
250 fourth variant of sixth embodiment of tip element (ladybug)
252 fifth variant of sixth embodiment of tip element (butterfly)
254 sixth variant of sixth embodiment of tip element (cloverleaf)
260 seventh embodiment
262 rib
264 canopy
270 seventh embodiment of tip element
272 base portion
274 top portion
276 living hinge
278 channel or central portion
280 living hinges
282 holes
284 projections

The invention claimed is:

1. A tip element, for mounting to an end of a single rib of an umbrella frame, without connection to any other element of the umbrella frame, the tip element comprising a mounting portion for mounting onto a rib of an umbrella and a pair of wings, the wings having an outer edge for defining part of an edge of a canopy mounted on the umbrella frame, wherein at least one wing is mounted for pivotal movement about an axis parallel to an axis of the umbrella rib, and relative to the other wing, and wherein the tip element is integrally molded from a plastic material and said one wing is pivotally connected to the mounting portion by a living hinge.

2. A tip element as claimed in claim 1, wherein the mounting portion includes a blind bore.

3. A tip element as claimed in claim 1, wherein the outer edge of each wing is curved.

4. A tip element as claimed in claim 3, wherein the radius of curvature of the outer edge or each tip element corresponds to the length of the umbrella rib, indicative of the radius of the umbrella canopy.

5. A tip element as claimed in claim 1, wherein the other wing of said pair of wings is pivotally connected to the mounting portion by a living hinge.

6. A tip element as claimed in claim 1, wherein the mounting portion has an axis and the wings are substantially symmetrical about the axis.

7. A tip element for mounting to an end of a single rib of an umbrella frame, without connection to any other element of the umbrella frame, the tip element being integrally molded in a plastic material and comprising a mounting portion for mounting onto a rib of an umbrella, a pair of wings extending from the mounting portion, wherein both wings are pivotally connected to the mounting portion by living hinges, for pivotal movement around about an axis parallel to an axis of the umbrella rib, the wings being symmetrical about the mounting portion.

8. A tip element as claimed in claim 7, wherein the wings taper in thickness away from the mounting portion, and at least tip portions of the wings, spaced away from the mounting portion, are sufficiently flexible, to enable the wings to at least partially wrap around an umbrella shaft.

9. An umbrella comprising: a main shaft; a plurality of ribs pivotally connected at one end thereof to an upper end of the main shaft; a support mechanism, including a slider mounted on the main shaft, and connected to the ribs, for displacing the ribs between open and closed positions; mounted on the end of each rib, a tip element as claimed in claim 1; and a canopy attached to the ribs.

10. An umbrella as claimed in claim 9, wherein the canopy includes, for each rib, extensions at least partially enclosing the corresponding tip element.

11. An umbrella as claimed in claim 10, wherein the extensions are connected to the canopy at discrete locations.

12. An umbrella as claimed in claim 9, wherein the canopy comprises a plurality of canopy pieces attached to one another along lines corresponding with the ribs of the umbrella frame, and wherein each extension comprises two extension pieces of two adjacent canopy pieces.

13. An umbrella as claimed in claim 12, wherein said two extension pieces of said two adjacent canopy pieces are attached to one another to form a pocket for enclosing a tip element.

14. An umbrella as claimed in claim 12, wherein said two extension pieces are attached to the respective canopy pieces and are separate from one another, with each extension piece enclosing one wing of a corresponding tip element.

15. An umbrella as claimed in claim 9, wherein the canopy comprises a plurality of canopy pieces attached to one another along lines corresponding with the ribs of the umbrella frame and wherein each extension comprises a single extension piece attached to the respective canopy piece.

16. An umbrella comprising: a main shaft; a plurality of ribs pivotally connected at one end thereof to an upper end of the main shaft; a support mechanism, including a slider mounted on the main shaft, and connected to the ribs, for displacing the ribs between open and closed positions; mounted on the end of each rib, on each rib a tip element as claimed in claim 7; and a canopy attached to the ribs.

17. An umbrella as claimed in claim 16, wherein the canopy includes, for each rib, extensions at least partially enclosing the corresponding tip element.

18. An umbrella as claimed in claim 16, wherein the wings are sufficiently flexible to enable the wings to wrap around the main shaft when the umbrella is in a closed configuration.

19. An umbrella as claimed in claim 16, wherein the canopy and the tip elements comprise materials that are welded together.

20. An umbrella as claimed in claim 19, wherein the canopy and the tip elements are made from plastic material.

21. An umbrella as claimed in claim 16, wherein the canopy is made from a material that is at least partially transparent and whereby the tip elements are visible through the canopy, and the tip elements have a profile that is visually attractive.

* * * * *